US008609582B2

(12) United States Patent
Hirai et al.

(10) Patent No.: US 8,609,582 B2
(45) Date of Patent: Dec. 17, 2013

(54) THERMOSENSITIVE RECORDING MEDIUM

(75) Inventors: Kenji Hirai, Tokyo (JP); Akihito Ogino, Tokyo (JP); Tsuyoshi Takagi, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 153 days.

(21) Appl. No.: 13/254,381

(22) PCT Filed: Mar. 19, 2010

(86) PCT No.: PCT/JP2010/054818

§ 371 (c)(1),
(2), (4) Date: Oct. 26, 2011

(87) PCT Pub. No.: WO2010/110209

PCT Pub. Date: Sep. 30, 2010

(65) Prior Publication Data

US 2012/0038737 A1 Feb. 16, 2012

(30) Foreign Application Priority Data

Mar. 24, 2009 (JP) ..... 2009-071436

(51) Int. Cl.
*B41M 5/44* (2006.01)

(52) U.S. Cl.
USPC ..... 503/226

(58) Field of Classification Search
USPC ..... 503/200–226
See application file for complete search history.

(56) References Cited

U.S. PATENT DOCUMENTS

| | | | |
|---|---|---|---|
| 4,032,690 | A | 6/1977 | Kohmura et al. |
| 4,243,716 | A | 1/1981 | Kosaka et al. |
| 4,265,978 | A | 5/1981 | Morishita et al. |
| 6,037,308 | A | 3/2000 | Sato et al. |
| 6,656,880 | B2 | 12/2003 | Aono |
| 6,680,281 | B2 | 1/2004 | Tajiri et al. |
| 7,157,407 | B2 | 1/2007 | Serizawa |
| 7,618,922 | B2 | 11/2009 | Ogino et al. |
| 8,129,307 | B2 | 3/2012 | Makihara et al. |
| 8,247,347 | B2 | 8/2012 | Takagi et al. |
| 8,283,284 | B2 | 10/2012 | Hirai et al. |
| 8,466,085 | B2 | 6/2013 | Kato et al. |
| 8,492,308 | B2 | 7/2013 | Kurihara et al. |
| 2003/0045426 | A1 | 3/2003 | Ito |
| 2004/0198603 | A1 | 10/2004 | Kawakami et al. |
| 2004/0241598 | A1 | 12/2004 | Suga et al. |
| 2005/0118526 | A1 | 6/2005 | Suga et al. |
| 2006/0264326 | A1 | 11/2006 | Fisher et al. |
| 2008/0139385 | A1 | 6/2008 | Ogino et al. |
| 2008/0214786 | A1 | 9/2008 | Oyama |
| 2010/0062935 | A1 | 3/2010 | Takagi et al. |
| 2010/0099557 | A1 | 4/2010 | Makihara et al. |
| 2010/0248959 | A1 | 9/2010 | Kato et al. |
| 2011/0105319 | A1 | 5/2011 | Hirai et al. |
| 2011/0130281 | A1 | 6/2011 | Kurihara et al. |
| 2011/0269622 | A1 | 11/2011 | Ohse et al. |
| 2012/0129692 | A1 | 5/2012 | Ohse et al. |
| 2013/0059728 | A1 | 3/2013 | Ohse et al. |

FOREIGN PATENT DOCUMENTS

| | | |
|---|---|---|
| EP | 0 465 665 | 1/1992 |
| EP | 0 764 635 | 3/1997 |
| EP | 0 779 539 | 6/1997 |
| EP | 1 116 713 | 7/2001 |
| EP | 1 199 185 | 4/2002 |
| EP | 1 367 437 | 12/2003 |
| EP | 1 437 231 | 7/2004 |
| EP | 1 747 898 | 1/2007 |
| EP | 1 808 304 | 7/2007 |
| EP | 2 072 274 | 6/2009 |
| EP | 2 145 771 | 1/2010 |
| GB | 2 187 297 | 9/1987 |
| JP | 53-091995 | 8/1978 |
| JP | 54-128349 | 10/1979 |
| JP | 57-165290 | 10/1982 |
| JP | 60-179190 | 9/1985 |
| JP | 60-179290 | 9/1985 |
| JP | 61-181680 | 8/1986 |
| JP | 61-291179 | 12/1986 |
| JP | 62-270383 | 11/1987 |
| JP | 1-196389 | 8/1989 |
| JP | 2-55188 | 2/1990 |
| JP | 03 047790 | 2/1991 |
| JP | 3-190786 | 8/1991 |
| JP | 3-205181 | 9/1991 |
| JP | 3-219993 | 9/1991 |

(Continued)

OTHER PUBLICATIONS

Notice of Allowance corresponding to U.S. Appl. No. 12/674,296 dated Apr. 10, 2013.

(Continued)

*Primary Examiner* — Bruce H Hess

(74) *Attorney, Agent, or Firm* — Jenkins, Wilson, Taylor & Hunt, P.A.

(57) ABSTRACT

The present invention presents a thermosensitive recording medium having sufficient water resistance against water or moisture when the thermosensitive recording medium is used outdoors and also having a superior printing run-ability when printing at high speed (sticking resistance), color developing sensitivity, scratching resistance, plasticizer resistance and solvent resistance.

The thermosensitive recording medium shows a superior water resistance and also shows a superior printing run-ability when printing at high speed (sticking resistance) etc, by installing a thermosensitive recording layer on a support and a protective layer on the thermosensitive recording layer, wherein the protective layer contains an acrylic resin with a glass transition temperature of higher than 50 degrees C. and lower than or equal to 95 degrees C.

17 Claims, No Drawings

(56) References Cited

FOREIGN PATENT DOCUMENTS

| | | |
|---|---|---|
| JP | H04-164687 | 6/1992 |
| JP | 05-139033 | 6/1993 |
| JP | 5-162443 | 6/1993 |
| JP | 5-221115 | 8/1993 |
| JP | H06-155916 | 6/1994 |
| JP | 6-234275 | 8/1994 |
| JP | 6-262853 | 9/1994 |
| JP | H06-270547 | 9/1994 |
| JP | H06-286308 | 10/1994 |
| JP | 6-340171 | 12/1994 |
| JP | 7149713 | 6/1995 |
| JP | 07-179041 | 7/1995 |
| JP | H07-266711 | 10/1995 |
| JP | 07-314896 | 12/1995 |
| JP | H08-059603 | 3/1996 |
| JP | 08-207443 | 8/1996 |
| JP | 08-324123 | 12/1996 |
| JP | H08-333329 | 12/1996 |
| JP | H09-142018 | 6/1997 |
| JP | H09-207435 | 8/1997 |
| JP | H09-263047 | 10/1997 |
| JP | H10-250232 | 9/1998 |
| JP | H10-258577 | 9/1998 |
| JP | 10-272839 | 10/1998 |
| JP | H10-297089 | 11/1998 |
| JP | H10-297090 | 11/1998 |
| JP | 10-324062 | 12/1998 |
| JP | 10-324064 | 12/1998 |
| JP | 11-314454 | 11/1999 |
| JP | 2000-143611 | 5/2000 |
| JP | 2000-168242 | 6/2000 |
| JP | 2000-177243 | 6/2000 |
| JP | 3058758 | 7/2000 |
| JP | 2000-289333 | 10/2000 |
| JP | 2001-287459 | 10/2001 |
| JP | 2001-322358 | 11/2001 |
| JP | 2001-323095 | 11/2001 |
| JP | 2002-011954 | 1/2002 |
| JP | 2002-019300 | 1/2002 |
| JP | 2002-103789 | 4/2002 |
| JP | 2002-240430 | 8/2002 |
| JP | 2002-264538 | 9/2002 |
| JP | 2002-293023 | 10/2002 |
| JP | 2002-301873 | 10/2002 |
| JP | 2002-341770 | 11/2002 |
| JP | 2003-019861 | 1/2003 |
| JP | 2003-154760 | 5/2003 |
| JP | 2003-212841 | 7/2003 |
| JP | 3439560 | 8/2003 |
| JP | 2003-313795 | 11/2003 |
| JP | 2004-202913 | 7/2004 |
| JP | 2005-001281 | 1/2005 |
| JP | 2005-041013 | 2/2005 |
| JP | 2005-134578 | 5/2005 |
| JP | 2005-154996 | 6/2005 |
| JP | 2005-199554 | 7/2005 |
| JP | 2005-220480 | 8/2005 |
| JP | 2005-262549 | 9/2005 |
| JP | 3716736 | 11/2005 |
| JP | 2006-069032 | 3/2006 |
| JP | 3750786 | 3/2006 |
| JP | 2006-095852 | 4/2006 |
| JP | 2006-168319 | 6/2006 |
| JP | 3790648 | 6/2006 |
| JP | 2006-175835 | 7/2006 |
| JP | 2006-205561 | 8/2006 |
| JP | 2006-264255 | 10/2006 |
| JP | 2006-281472 | 10/2006 |
| JP | 2007-196616 | 8/2007 |
| JP | 2007-231485 | 9/2007 |
| JP | 3971453 | 9/2007 |
| JP | 2008-012879 | 1/2008 |
| JP | 2008-018619 | 1/2008 |
| JP | 2008-044226 | 2/2008 |
| JP | 2008-044227 | 2/2008 |
| JP | 2008-105222 | 8/2008 |
| JP | 2008-194918 | 8/2008 |
| JP | 2008-248408 | 10/2008 |
| JP | 2008-248459 | 10/2008 |
| JP | 2009-012247 | 1/2009 |
| WO | WO93/06074 | 4/1993 |
| WO | WO95/33714 | 12/1995 |
| WO | WO97/16420 | 5/1997 |
| WO | WO00/14058 | 3/2000 |
| WO | WO01/25193 | 4/2001 |
| WO | WO02/081229 | 10/2002 |
| WO | WO02/098674 | 12/2002 |
| WO | WO03/029017 | 4/2003 |
| WO | WO2004/002748 | 1/2004 |
| WO | WO2005/087503 | 9/2005 |
| WO | WO2005/087504 | 9/2005 |
| WO | WO2005/102725 | 11/2005 |
| WO | WO2006/075467 | 7/2006 |
| WO | WO2007/049621 | 5/2007 |
| WO | WO2008/099658 | 8/2008 |
| WO | WO2008/126635 | 10/2008 |
| WO | WO2008/139948 | 11/2008 |
| WO | WO2009/025316 | 2/2009 |
| WO | WO2009/028118 | 3/2009 |
| WO | WO2009/119813 | 10/2009 |
| WO | WO2010/110209 | 9/2010 |
| WO | WO2010/140662 | 12/2010 |
| WO | WO2011/114780 | 9/2011 |

OTHER PUBLICATIONS

Notice of Allowance corresponding to U.S. Appl. No. 12/675,701 dated Apr. 4, 2013.

Official Action corresponding to U.S. Appl. No. 12/934,230 dated Apr. 25, 2013.

Extended European Search Report corresponding to European Patent Application No. 10 756 006.2-2304 dated Apr. 11, 2012.

International Search Report corresponding to International Patent Application No. PCT/JP2011/051714 dated Apr. 5, 2011.

Notice of Allowance corresponding to U.S. Appl. No. 12/599,617 dated Jun. 27, 2012.

Notice of Opposition corresponding to European Patent Application No. 08 752 259.5-1251/2145771 dated Jun. 14, 2012.

Notification of Transmittal of Translation of the International Preliminary Report on Patentability (Chapter I or Chapter II of the Patent Cooperation Treaty) corresponding to International Patent Application No. PCT/JP2011/051714 dated Nov. 8, 2012.

Official Action corresponding to U.S. Appl. No. 12/674,296 dated Jul. 9, 2012.

Official Action corresponding to U.S. Appl. No. 12/674,296 dated Feb. 6, 2013.

Supplemental Notice of Allowability corresponding to U.S. Appl. No. 12/599,617 dated Aug. 13, 2012.

Extended European Search Report corresponding to European Patent Application No. 08 827 733.0-2304 dated Jan. 27, 2012.

European European Search Report corresponding to European Patent Application No. 09 725 687.9-2304 dated Feb. 24, 2012.

International Search Report corresponding to International Patent Application No. PCT/JP2007/074385 dated Feb. 14, 2008.

International Search Report corresponding to International Patent Application No. PCT/JP2008/051100 dated Apr. 15, 2008.

International Search Report corresponding to International Patent Application No. PCT/JP2008/054719 dated Sep. 22, 2008.

International Search Report corresponding to International Patent Application No. PCT/JP2008/058329 dated Jun. 9, 2008.

International Search Report corresponding to International Patent Application No. PCT/JP2008/064904 dated Oct. 7, 2008.

International Search Report corresponding to International Patent Application No. PCT/JP2009/056306 dated May 19, 2009.

International Search Report corresponding to International Patent Application No. PCT/JP2010/054818 dated Apr. 13, 2010.

International Search Report corresponding to International Patent Application No. PCT/JP2010/059462 dated Aug. 17, 2010.

(56) References Cited

OTHER PUBLICATIONS

Isogai et al., "Effects of Carboxyl Groups in Pulp on Retention of Alkylketene Dimer," Journal of Pulp and Paper Science. vol. 23, No. 5 pp. J215-J219 (1997).
Japanese Industrial Standard (JIS) P-8148. Paper, board and pulps—Measurement of diffuse blue reflectance factor (ISO brightness). Japanese Standards Association (2001).
Notice of Allowance corresponding to U.S. Appl. No. 12/520,514 dated Oct. 26, 2011.
Notice of Allowance corresponding to U.S. Appl. No. 12/593,116 dated May 15, 2012.
Notice of Allowance corresponding to U.S. Appl. No. 12/599,617 dated Apr. 16, 2012.
Notification Concerning Transmittal of International Preliminary Report on Patentability (Chapter I of the Patent Cooperation Treaty) corresponding to International Patent Application No. PCT/JP2009/056306 dated Oct. 7, 2010.
Notification Concerning Transmittal of Internationl Preliminary Report on Patentability (Chapter I of the Patent Cooperation Treaty) corresponding to International Patent Application No. PCT/JP2010/054818 dated Sep. 24, 2011.
Notification of Transmittal of Translation of the International Preliminary Report on Patentability (Chapter I or Chapter II of the Patent Cooperation Treaty) corresponding to International Patent Application No. PCT/JP2007/074385 dated Mar. 18, 2010.
Notification of Transmittal of Translation of the International Preliminary Report on Patentability (Chapter I or Chapter II of the Patent Cooperation Treaty) corresponding to International Patent Application No. PCT/JP2008/051100 dated Aug. 27, 2009.
Notification of Transmittal of Translation of the International Preliminary Report on Patentability (Chapter I or Chapter II of the Patent Cooperation Treaty) corresponding to International Patent Application No. PCT/JP2008/054719 dated Oct. 29, 2009.
Notification of Transmittal of Translation of the International Preliminary Report on Patentability (Chapter I or Chapter II of the Patent Cooperation Treaty) corresponding to International Patent Application No. PCT/JP2008/058329 dated Jan. 21, 2010.
Notification of Transmittal of Translation of the International Preliminary Report on Patentability (Chapter I or Chapter II of the Patent Cooperation Treaty) corresponding to International Patent Application No. PCT/JP2008/064904 dated Mar. 18, 2010.
Notification of Transmittal of Translation of the International Preliminary Report on Patentability (Chapter 1 or Chapter II of the Patent Cooperation Treaty) corresponding to International Patent Application No. PCT/JP2009/056306 dated Nov. 18, 2010.
Notification of Transmittal of Translation of the International Preliminary Report on Patentability (Chapter I or Chapter II of the Patent Cooperation Treaty) corresponding to International Patent Application No. PCT/JP2010/054818 dated Jan. 12, 2012.
Notification of Transmittal of Translation of the International Preliminary Report on Patentability (Chapter I or Chapter II of the Patent Cooperation Treaty) corresponding to International Patent Application No. PCT/JP2010/059462 dated Dec. 15, 2011.
Official Action corresponding to U.S. Appl. No. 12/520,514 dated Mar. 10, 2010.
Official Action corresponding to U.S. Appl. No. 12/520,514 dated Oct. 27, 2010.
Official Action corresponding to U.S. Appl. No. 12/593,116 dated Feb. 1, 2012.
Supplementary European Search Report corresponding to European Patent Application No. 08703912.9-1251/2112001 dated Jan. 22, 2010.
Supplementary European Search Report corresponding to European Patent Application No. 08722115.6-1251/2130681 dated Mar. 5, 2010.
Translation, "Explanation for filing a request for early examination," filed in the corresponding JP application (2007-282831) on Feb. 10, 2009.
Translation, "Opinion," filed in the corresponding JP application (2007-282831) on Mar. 24, 2009 in response to an office action of Mar. 9, 2009.
Translation, "Test Report," filed in the corresponding JP application (2007-282831) on Feb. 10, 2009.
Official Action corresponding to U.S. Appl. No. 13/375,375 dated Jul. 11, 2013.

THERMOSENSITIVE RECORDING MEDIUM

RELATED APPLICATIONS

The application is the U.S. National Stage of PCT International Application No. PCT/JP2010/054818, filed on Mar. 19, 2010, which claims priority to Japanese Patent Application No. 2009-071436, filed on Mar. 24, 2009.

FIELD OF THE INVENTION

The present invention relates to a thermosensitive recording medium having a superior water resistance, printing run-ability when printing at high speed (sticking resistance), color developing sensitivity, scratching resistance, plasticizer resistance and solvent resistance.

BACKGROUND OF THE INVENTION

A thermosensitive recording medium is obtained by grinding a colorless or pale colored basic leuco dye (henceforth referred to as "dye") and an electron accepting color developing agent (henceforth referred to as "color developing agent") each into fine particles, preparing dispersions, blending the dispersions, preparing a coating solution by adding a binder, a filler, a sensitivity improving agent, a lubricant and other aids and applying the coating solution on a support material such as paper, synthetic paper, film, plastic and the like. The color is developed instantaneously through a chemical reaction when heated using a thermal head, hot stamp, thermal pen, laser beam and the like to yield a recorded image. The thermosensitive recording medium is being used extensively in facsimiles, terminal printers of computers, automatic ticket vending machines, measurement recorders and the like. As the thermosensitive recording medium becomes to be used in various applications, higher level of image stability and stability in white part against water, oil, plasticizer, solvent and the like are required. When a mobile type printer is used outdoors, sticking resistance is especially required. Sticking resistance is referred as a property resistant to a problem, that is, an outer surface of a thermosensitive recording medium is heated by a printer and sticks to the printer head, in which some part of the thermosensitive recording medium is not printed. As the quality of thermal printing becomes high recently, in which, the printing precision is more than 200 dpi or the printing speed is more than 100 mm/sec, a thermosensitive recording medium suitable for these new applications is demanded.

It is well known to install a protective layer on a thermosensitive recording layer in order to improve a storage stability of a thermosensitive recording medium. It is also commonly conducted to have the protective layer contain a polyvinyl alcohol to improve membrane strength or an acrylic resin to improve water resistance and chemical resistance (References 1, 2 etc.). However, while a hydrophobic resin emulsion, such as acrylic emulsion, is used in a protective layer to improving water resistance of a thermosensitive recording medium (Reference 3), printing run-ability, such as sticking resistance, becomes worse because of insufficient heat resistance of the acrylic emulsion. And it is conducted to have a protective layer contain various inorganic pigments, such as kaoline, in order to improve printing run-ability (Reference 4).

Reference 1: Japanese Patent Application Public Disclosure H11-314454

Reference 2: International Publication WO2007/049621

Reference 3: Japanese Patent Application Public Disclosure H01-196389

Reference 4: Japanese Patent No. 3971453

Problems to be Solved by the Invention

The objective of the present invention is to provide a thermosensitive recording medium having a sufficient water resistance against water or moisture when the thermosensitive recording medium is used outdoors and also having a superior printing run-ability when printing at high speed (sticking resistance), color developing sensitivity, scratching resistance, plasticizer resistance and solvent resistance.

Means to Solve the Problems

The inventors discovered that a thermosensitive recording medium shows a superior water resistance and also shows a superior printing run-ability when printing at high speed (sticking resistance), color developing sensitivity, scratching resistance, plasticizer resistance and solvent resistance, by having the protective layer of the thermosensitive recording medium contain an acrylic resin with a glass transition temperature of higher than 50 degrees C. and lower than or equal to 95 degrees C., and the present invention was completed based on the discovery.

That is, the present invention is a thermosensitive recording medium having a thermosensitive recording layer on a support and a protective layer on the thermosensitive recording layer, wherein the protective layer comprises an acrylic resin with a glass transition temperature of higher than 50 degrees C. and lower than or equal to 95 degrees C.

DETAILED DESCRIPTION OF THE INVENTION

The protective layer installed on the thermosensitive recording layer of the thermosensitive recording medium of the present invention comprises an acrylic resin with a glass transition temperature (Tg) of higher than 50 degrees C. and lower than or equal to 95 degrees C. as a binder. The acrylic resin used in the present invention contains (meth)acrylic acid and a monomer that can be copolymerized with (meth)acrylic acid. The amount of (meth)acrylic acid in the acrylic resin is preferably from 1 to 10 parts by weight per 100 parts by weight of acrylic resin. The (meth)acrylic acid is soluble in alkali and has a characteristic activity of converting an acrylic resin to a water soluble resin by adding a neutralizer. By converting an acrylic resin to a water soluble resin, the affinity to pigments becomes improved, when a protective layer contains pigments, which makes the protective layer have a superior strength even in the presence of a large amount of pigments. The monomer element that can be copolymerized with (meth)acrylic acid includes, for example, alkyl acrylic acid resin, such as methyl(meth)acrylate, ethyl(meth)acrylate, propyl(meth)acrylate, iso-butyl(meth)acrylate, pentyl (meth) acrylate, hexyl (meth)acrylate, 2-ethyl hexyl (meth)acrylate, octyl (meth)acrylate and the like, modified alkyl acrylic acid resin, such as alkyl acrylic acid resin as above that is modified with epoxy resin, silicone resin, styrene or these derivatives, (meth)acrylonitrile, acrylic ester and hydroxy-alkyl acrylic ester. Among these, (meth)acrylonitrile and/or methyl (meth) acrylate are preferred. The amount of (meth)acrylonitrile in the acrylic resin is preferably from 15 to 70 parts by weight per 100 parts by weight of acrylic resin and the amount of methyl (meth)acrylate in the acrylic resin is preferably from 20 to 80 parts by weight per 100 parts by weight of acrylic resin.

The glass transition temperature (Tg) of the acrylic resin of the present invention is higher than 50 degrees C. and lower than or equal to 95 degrees C. When the Tg is lower than or equal to 50 degrees C., sufficient heat resistance cannot be attained and a sticking problem occurs, although water resistance is improved. On the contrary, when an acrylic resin with higher Tg is contained, sticking resistance and scratching resistance tend to be improved. However, when the Tg of the acrylic resin is too high, the protective layer becomes brittle and the water resistance, plasticizer resistance and solvent resistance become insufficient, then the objective effect of the present invention may not be attained. The Tg of acrylic resin is measured by differential scanning calorimetry (DSC).

The acrylic resin that can be used in the present invention is preferably a non-core-shell type acrylic resin. In general, a core-shell type acrylic resin is widely used since a core-shell type acrylic resin is superior to a non-core-shell type acrylic resin in thermal resistance and sticking resistance when used in a coating layer. However, a core-shell type acrylic resin can also have a disadvantage, that is, color developing sensitivity is inferior because of lower thermal-conductivity. On the other hand, a non-core-shell type acrylic resin is normally less heat resistant and has a disadvantage that sticking problems and head debris problems often occur. However, a non-core-shell type acrylic resin with a Tg of higher than 50 degrees C. and lower than or equal to 95 degrees C. is superior in heat resistance, and therefore has an advantage that sticking resistance and prevention of head debris are superior.

The protective layer of the present invention preferably further contains a water soluble polymer as a binder. When a protective layer contains acrylic resin, viscosity and water-retaining property are low, and then the coated surface tends to be uneven. However, when a water soluble polymer and an acrylic resin are concurrently used, the coated surface tends to be even.

The water soluble polymer includes, for example, polyvinyl alcohols, such as polyvinyl alcohol, completely saponified polyvinyl alcohol, partially saponified polyvinyl alcohol, carboxyl modified polyvinyl alcohol, silanol modified polyvinyl alcohol, cationic modified polyvinyl alcohol, terminal alkyl modified polyvinyl alcohol and the like, cellulose ether and its derivatives (henceforth referred to as "cellulose ethers") such as hydroxyethyl cellulose, methyl cellulose, ethyl cellulose, carboxymethyl cellulose, acetyl cellulose and the like, starches, such as starch, oxygen modified starch, thermo-chemically modified starch, oxidized starch, esterified starch, etherized starch (for example, hydroxy ethyl modified starch), cationic starch and the like, polyacrylamides, such as polyacrylamide, cationic polyacrylamide, anionic polyacrylamide, amphoteric polyacrylamide and the like, styrene-butadiene copolymer, polyvinyl acetate, poly vinyl chloride-vinyl acetate copolymer, poly vinyl chloride, polyvinylidene chloride, polyacrylic ester, gum arabic, and the like. These may be used in combination.

Among these, polyvinyl alcohols, cellulose ethers and starches are preferable because their water solubilities are higher. And polyvinyl alcohols and cellulose ethers are more preferable because these bind with water molecules to improve viscosity of coating solution and water-retaining property. More preferable is to use polyvinyl alcohols and cellulose ethers concurrently because these are soluble with each other and coating solution becomes stable at high shear when coated on a support.

The binders, other than acrylic resin and water soluble polymer, that can be used in the present invention include polyvinyl butyral, polystyrols and their copolymers, silicone resins, petroleum resins, terpene resins, ketone resins, cumaro resins and the like.

The protective layer of the present invention preferably further contains pigment. The aspect ratio of the pigment is preferably more than or equal to 30. The poor plasticizer resistance and solvent resistance, which are caused by the acrylic resin with high Tg, can be recovered by adding this type of pigment to the protective layer. And sticking resistance can be improved by adding pigments to the protective layer.

As the pigment used in the present invention, inorganic or organic fillers and the like such as kaolin, calcined kaolin, aluminum hydroxide, silica, calcium carbonate, diatomaceous earth, talc, titanium oxide, and the like may be cited. As the pigment used in the protective layer, kaolin, calcined kaolin and aluminum hydroxide are preferred. Thermosensitive recording medium with further superior quality can be prepared by using the acrylic resin described above and kaolin with an aspect ratio of more than or equal to 30 concurrently.

The aspect ratio of pigments is obtained by taking a photograph of the pigment powder, measuring diameter and thickness for randomly chosen 100 powder particles, and calculating the ratio of diameter/thickness to average these ratios. As the aspect ratio is lager, the flatness of pigment is larger.

Kaolin having an aspect ratio of more than or equal to 30 is very flat as compared with the pigments that are normally used in the paper industry. The amount of this flat kaolin necessary to cover the same area is less than that of kaolin with smaller aspect ratio. Therefore the protective layer can be made thin in thickness, which improves the thermal conductivity through the protective layer and then superior color developing sensitivity and image quality can be obtained The aspect ratio of kaolin that can be used in the present invention is preferably from 30 to 100, more preferably from 30 to 75. If the aspect ratio is larger than 100, water-retaining property of coating becomes degraded and then coating applicability becomes significantly poor. And the protective layer becomes unevenly thick and then color is developed undesirably uneven. The average diameter of kaolin is preferably less than or equal to 4 micrometers. If the average diameter of kaolin is larger than 4 micrometers, the surface becomes less smooth and then the recorded image quality may become degraded.

The oil absorbance of kaolin that can be used in the present invention is usually from 50 to 80 ml/100 g, and its BET specific surface is usually from 10 to 30 $m^2/g$. While the oil absorbance of mica having an aspect ratio of higher than or equal to 100 is about from 10 to 30 ml/100 g, and BET specific surface is about from 2 to 10 $m^2/g$. The capability of this mica to absorb water or solvent is low. Therefore, when kaolin of the present invention is used, water resistance, solvent resistance and prevention of head debris are better than when mica is used. The kaolin with an aspect ratio of more than or equal to 30 of the present invention can be obtained by crushing raw kaolin to delaminate and classifying thus obtained kaolin and the like.

The amount of acrylic resin in the protective layer of the present invention is, in terms of solid content, usually from 15 to 100 weight %, preferably from 50 to 100 weight %.

When the protective layer further contains water soluble polymer, the amount of water soluble polymer is, in terms of solid content, preferably from 5 to 70 parts by weight, more preferably from 10 to 50 parts by weight, per 100 parts by weight of the solid content of acrylic resin. When the protective layer contains polyvinyl alcohols and cellulose ethers concurrently, the amount of cellulose ethers is, in terms of solid content, preferably from 20 to 100 parts by weight, more preferably from 40 to 100 parts by weight, per 100 parts by weight of the solid content of polyvinyl alcohols. When the protective layer contains pigments, the amount of pigments in the protective layer is, in terms of solid content, normally from 25 to 75 weight %, preferably from 30 to 70 weight %. It is preferable to use solely the kaolin having an aspect ratio of more than or equal to 30 as a pigment, however, more than two kinds of pigments may be used. The amount of kaolin with an aspect ratio of more than or equal to 30 in total pigments is preferably more than or equal to 50 weight %, preferably more than or equal to 80 weight %.

The total amount of acrylic resin, water soluble polymer and pigments in the protective layer is, in terms of solid content, usually from 50 to 100 weight %, preferably from 60 to 100 weight %.

The thermosensitive recording layer of the present invention contains essentially a dye and a color developing agent and may optionally further contain sensitizers, binders described above, crosslinking agents, slipping agents, pigments and the like.

All of the dyes well known in the conventional field of pressure sensitive and thermosensitive recording media may be used as the dye in a thermosensitive recording medium of the present invention. Although the dye is not particularly restricted, triphenylmethane type compounds, fluorane type compounds, fluorene type compounds, divinyl type compounds and the like are preferred. Specific examples of the typical colorless to pale colored basic colorless dye are shown below. In addition, these basic colorless dyes may be used individually or also in mixtures of at least two of them.

<Triphenylmethane Type Leuco Dyes>

3,3-bis(p-dimethyl aminophenyl)-6-dimethylaminophthalide [alternate name: crystal violet lactone] and 3,3-bis(p-dimethyl aminophenyl) phthalide [alternate name: malachite green lactone]

<Fluorane Type Leuco Dyes>

3-Diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino) fluorane, 3-diethylamino-6-methyl-7-(o-chloroanilino) fluorane, 3-diethylamino-6-methyl-7-(p-chloroanilino) fluorane, 3-diethylamino-6-methyl-7-(o-fluoroanilino) fluorane, 3-diethylamino-6-methyl-7-(m-methylanilino) fluorane, 3-diethylamino-6-methyl-7-n-octylanilino fluorane, 3-diethylamino-6-methyl-7-n-octylamino fluorane, 3-diethylamino-6-methyl-7-benzylamino fluorane, 3-diethylamino-6-methyl-7-dibenzylamino fluorane; 3-diethylamino-6-chloro-7-methyl fluorane, 3-diethylamino-6-chloro-7-anilino fluorane, 3-diethylamino-6-chloro-7-p-methylanilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanilino) fluorane, 3-diethylamino-7-(o-chloro anilino) fluorane, 3-diethylamino-7-(p-chloroanilino) fluorane, 3-diethylamino-7-(o-fluoroanilino) fluorane, 3-diethylamino-benz[a] fluorine; 3-diethylamino-benz[c] fluorane, 3-dibutylamino-6-methyl-fluorane, 3-dibutylamino-6-methyl-7-anilino fluorane, 3-dibutylamino-6-methyl-7-(o,p-dimethylanilino) fluorane, 3-dibutylamino-7-(o-chloroanilino) fluorane, 3-butylamino-6-methyl-7-(p-chloro anilino) fluorane, 3-dibutylamino-6-methyl-7-(o-fluoroanilino) fluorane, 3-dibutylamino-6-methyl-7-(m-fluoroanilino) fluorane, 3-dibutylamino-6-methyl-chloro fluorane, 3-dibutylamino-6-ethoxyethyl-7-anilino fluorane, 3-dibutylamino-6-chloro-7-anilino fluorane, 3-dibutylamino-6-methyl-7-p-methylanilino fluorane, 3-dibutylamino-7-(o-chloro anilino) fluorane, 3-dibutylamino-7-(o-fluoroanilino) fluorane, 3-di-n-pentylamino-6-methyl-7-anilino fluorane, 3-di-n-pentylamino-6-methyl-7-(p-chloroanilino) fluorane, 3-di-n-pentylamino-7-(m-trifluoromethylanilino) fluorane, 3-di-n-pentylamino-6-chloro-7-anilino fluorane, 3-di-n-pentylamino-7-(p-chloroanilino) fluorane, 3-pyrolidino-6-methyl-7-anilino fluorane, 3-piperidino-6-methyl-7-anilino fluorane, 3-(N-methyl-N-propylamino)-6-methyl-7-anilino fluorane, 3-(N-methyl-N-cyclohexylamino)-6-methyl-7-anilino fluorane, 3-(N-ethyl-N-cyclohexylamino)-6-methyl-7-anilino fluorane, 3-(N-ethyl-N-xylylamino)-6-methyl-7-(p-chloroanilino) fluorane, 3-(N-ethyl-p-toluidino)-6-methyl-7-anilino fluorane, 3-(N-ethyl-N-isoamylamino)-6-methyl-7-anilino fluorane, 3-(N-ethyl-N-isoamylamino)-6-chloro-7-anilino fluorane, 3-(N-ethyl-N-tetrahydrofurfurylamino)-6-methyl-7-anilino fluorane, 3-(N-ethyl-N-isobutylamino)-6-methyl-7-anilino fluorane, 3-(N-ethyl-N-ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-p-(p-dimethylaminophenyl) aminoanilino fluorane, 2-methoxy-6-p-(p-dimethylaminophenyl) aminoanilino fluorane, 2-chloro-3-methyl-6-p-(p-phenylaminophenyl) aminoanilino fluorane, 2-chloro-6-p-(p-dimethylaminophenyl) aminoanilino fluorane, 2-nitro-6-p-(p-diethylaminophenyl) aminoanilino fluorane, 2-amino-6-p-(p-diethylaminophenyl) aminoanilino fluorane, 2-diethylamino-6-p-(p-diethylaminophenyl) aminoanilino fluorane, 2-phenyl-6-methyl-6-p-(p-phenylaminophenyl) aminoanilino fluorane, 2-benzyl-6-p-(p-phenylaminophenyl) aminoanilino fluorane, 2-hydroxy-6-p-(p-phenylaminophenyl)aminoanilino fluorane, 3-methyl-6-p-(p-dimethylaminophenyl) aminoanilino fluorane, 3-diethylamino-6-p-(p-diethylaminophenyl) aminoanilino fluorane, 3-diethylamino-6-p-(p-dibutylaminophenyl) aminoanilino fluorane and 2,4-dimethyl-6-[(4-dimethylamino) anilino] fluorane.

<Fluorene Type Leuco Dye>

3,6,6-Tris(dimethylamino) spiro[fluorene-9,3'-phthalide] and 3,6,6'-tris(diethylamino) spiro [fluorene-9,3'-phthalide].

<Divinyl Type Leuco Dyes>

3,3-bis-[2-(p-dimethyl aminophenyl)-2-(p-methoxyphenyl) ethenyl]-4,5,6,7-tetrabromophthalide, 3,3-bis-[2-(p-dimethylaminophenyl)-2-(p-methoxyphenyl) ethenyl]-4,5,6,7-tetrachlorophthalide, 3,3-bis-[1,1-bis(4-pyrolidinophenyl) ethylene-2-yl]-4,5,6,7-tetrabromophthalide and 3,3-bis-[1-(4-methoxyphenyl)-1-(4-pyrolydinophenyl) ethylene-2-yl]-4,5,6,7-tetrchlorophthalide.

<Others>

3-(4-Diethylamino-2-ethoxyphenyl)-3-(1-ethyl-2-methylindol-3-yl)-4-azaphth alide, 3-(4-diethylamino-2-ethoxyphenyl)-3-(1-octyl-2-methylindol-3-yl)-4-azaphthalide, 3-(4-cyclohexyl ethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane-γ-(3'-nitro)anilinolactam, 3,6-bis(diethylamino)fluorane-γ-(4'-nitro) anilinolactam, 1,1-bis-[2',2',2",2"-tetrakis-(p-dimethylaminophenyl)-ethenyl]-2,2-dinitrilethane, 1,1-bis-[2',2',2", 2"-tetrakis-(p-dimethylaminophenyl)-ethenyl]-2-6-naphthoylethane, 1,1-bis-[2',2',2",2"-tetrakis-(p-dimethylaminophenyl)-ethenyl]-2,2-diacetylethane and bis-

[2,2,2',2'-tetrakis-(p-dimethylaminophenyl)-ethenyl]-methylmalonic acid dimethyl ester.

All of the color development agents well known in the conventional field of pressure sensitive and thermosensitive recording media may be used as the color development agent in a thermosensitive recording material of the present invention. Although the dye is not particularly restricted, activated clay, attapulgite, colloidal silica, inorganic acidic substances such as aluminum silicate and the like, 4,4'-isopropylidene diphenol, 1,1-bis(4-hydroxyphenyl) cyclohexane, 2,2-bis(4-hydroxyphenyl)-4-methylpentane, 4,4'-dihydroxydiphenyl sulfide, hydroquinone monobenzyl ether, benzyl 4-hydroxybenzoate, 4,4'-dihydroxy diphenyl sulfone, 2,4'- dihydroxy diphenyl sulfone, 4-hydroxy-4'-isopropxy diphenyl sulfone, 4-hydroxy-4'-n-propoxy diphenyl sulfone, bis(3-allyl-4-hydroxyphenyl) sulfone, 4-hydroxy-4'-methyl diphenyl sulfone, 4-hydroxyphenyl-4'-benzyloxyphenyl sulfone, 3,4-dihydroxyphenyl-4'-methyl phenyl sulfone, aminobenzene sulfonamide derivatives described in Japanese Patent Application Public Disclosure No. H08-59603, bis(4-hydroxyphenyl thioethoxy) methane, 1,5-di(4-hydroxyphenyl thio)-3-oxapentane, butyl bis(p-hydroxyphenyl) acetate, methyl bis (p-hydroxyphenyl) acetate, 1,1-bis(4-hydroxyphenyl)-1-phenyl ethane, 1,4-bis[α-methyl-α-(4'-hydroxyphenyl) ethyl] benzene, 1,3-bis[α-methyl-α-(4'-hydroxyphenyl) ethyl] benzene, di(4-hydroxy-3-methylphenyl) sulfide, 2,2'-thiobis(3-tert-octylphenol), 2,2'-thiobis(4-tert-octylphenol), phenolic compounds such as diphenyl sulfone crosslinked compounds and the like described in International Publication WO97/16420, phenolic compounds described in International Publication WO02/081229 or Japanese Patent Application Public Disclosure No. 2002-301873, thiourea compounds such as N,N'-di-m-chlorophenyl thiourea and the like, p-chlorobenzoic acid, stearyl gallate, bis[zinc 4-octyloxy carbonylamino] salicylate dihydrate, 4-[2-(p-methoxyphenoxy) ethyloxy] salicylic acid, 4-[3-(p-trisulfonyl) propyloxy] salicylic acid, aromatic carboxylic acids such as 5-[p-(2-p-methoxyphenoxyethoxy) cumyl] salicylic acid and salts of these aromatic carboxylic acids and polyvalent metals such as zinc, magnesium, aluminum, calcium, titanium, manganese, tin, nickel and the like, and, furthermore, antipirin complexes of zinc thiocyanate and complex zinc salts and the like of terephthal aldehyde acid with other aromatic carboxylic acids, for example, may be cited. These color development agents may be used individually and in mixtures of at least two. The diphenylsulfone crosslinked type compound described in International Publication WO97/16420 is available under the trade name of D-90 produced by Nippon Soda Co., Ltd. The compound described in International Publication WO02/081229 is also available under the trade names of NKK-395 and D-100 produced by Nippon Soda Co., Ltd. In addition, high molecular weight aliphatic acid metal complex salts described in Japanese Patent Application Public Disclosure No. H10-258577 and metal chelate type color development components such as polyvalent hydroxy aromatic compounds and the like may also be present.

It is preferable to use a sensitizer whose melting point is equal to or higher than 90 degrees C. in the thermosensitive recording layer to obtain better color developing sensitivity. If the melting point is lower than 90 degrees C., problems such as head debris and sticking tend to occur. The sensitizer whose melting point is equal to or higher than 90 degrees C. includes diphenyl sulfone, aliphatic acid amides such as stearic acid amide, palmitic acid amide and the like, benzyloxy naphthalene, 1,2-di-(3-methylphenoxy) ethane, di-(p-methylbenzyl) oxalate. However, the sensitizer is not particularly restricted to the examples listed. The sensitizers may be used solely or as mixtures of at least two of them.

As the crosslinking agent used in the present invention, glyoxal, methylol melamine, melamine formaldehyde resins, melamine urea resins, polyamine epichlorohydrin resins, polyamide epichlorohydrin resins, potassium persulfate, ammonium persulfate, sodium persulfate, ferric chloride, magnesium chloride, borax, boric acid, alum, ammonium chloride and the like may be listed as examples.

As the slipping agent used in the present invention, fatty acid metal salts such as zinc stearate, calcium stearate and the like, wax, silicone resins and the like may be cited.

As stabilizers in the present invention that impart oil resistance and the like to recorded images, 4,4'-butylidene (6-t-butyl-3-methylphenol), 2,2'-di-t-butyl-5,5'-dimethyl-4,4'-sulfonyl diphenol, 1,1,3-tris(2-methyl-4-hydroxy-5-cyclohexylphenyl) butane, 1,1,3-tris(2-methyl-4-hydroxy-5-t-butylphenyl) butane, 4-benzyloxy-4'-(2,3-epoxy-2-methyl propoxy)diphenylsulfone and the like may be used.

In addition, UV absorption agents, such as benzophenone type and triazole type UV absorption agents, dispersion agents, defoaming agents, oxidation inhibitors, fluorescent dye and the like may also be used.

In the present invention, it is preferable that the thermosensitive recording layer of the present invention contains at least one of polyvinyl alcohol modified with carboxyl groups and epichlorohydrin type resins, and it is more preferable that the thermosensitive recording layer contains both polyvinyl alcohol modified with carboxyl groups and epichlorohydrin type resins, since the adhesion to the protective layer is enhanced and the water resistance of the thermosensitive recording medium is improved.

The carboxyl modified polyvinyl alcohol used in the present invention is a water soluble polymer into which carboxyl groups have been introduced for the purpose of enhancing the reactivity and is a reaction product of polyvinyl alcohol with a polyvalent carboxylic acid such as fumaric acid, phthalic anhydride, mellitic anhydride, itaconic anhydride and the like or an ester of the reaction product, or a saponified copolymer of vinyl acetate with a dicarboxylic acid with ethylene type unsaturation such as maleic acid, fumaric acid, itaconic acid, crotonic acid, acrylic acid, methacrylic acid and the like. More specifically, the product is obtained using the production process listed as examples in, for example, Japanese Patent Application Public Disclosure No. S53-91995.

As specific examples of the epichlorohydrin type resin used in the present invention, polyamide epichlorohydrin resins, polyamine epichlorohydrin resins and the like may be cited and may be used individually or jointly. In addition, as the amine present in the main chain of the epichlorohydrin type resin, primary to quaternary amines may be used without particular restrictions. Furthermore, a degree of cationization of 5 meq/g■solid or less (measured at pH 7) and a molecular weight of at least 500,000 are preferred based on good water resistance. As specific examples, Sumirez resin 650 (30), Sumirez resin 675A, Sumirez resin 6615 (all manufactured by Sumitomo Chemical Co., Ltd.), WS 4002, WS 4020, WS 4024, WS 4030, WS 4046, WS 4010, CP 8970 (all manufactured by Seiko PMC Corporation) and the like may be cited.

The type and amount of the dye, color developing agent and other various ingredients used in a thermosensitive recording layer of the present invention are determined according to the performance and recording capability required and are not particularly restricted. Ordinarily, however, the use of 0.5 to 10 parts of a color developing agent and 0.5 to 10 parts of a sensitizer are used per one part of a dye.

When carboxyl modified polyvinyl alcohol, epichlorohydrin type resin or both is contained in the thermosensitive recording layer of the present invention, the content as a solid of the carboxyl modified polyvinyl alcohol is preferably equal to or more than 30 weight %, more preferably 50 to 100 weight % of total binder in the thermosensitive recording layer. The content as a solid of the epichlorohydrin type resin is preferably equal to or more than 5 weight %, more preferably 10 to 50 weight % of total binder in the thermosensitive recording layer. When both carboxyl modified polyvinyl alcohol and epichlorohydrin type resin are contained in the thermosensitive recording layer, the content of the epichlorohydrin type resin is preferably 1 to 100 parts by weight, more preferably 5 to 50 parts by weight per 100 parts by weight of the carboxyl modified polyvinyl alcohol.

The dye, the color developing agent and other materials added as needed are finely ground into particles several microns or smaller in size, using a grinder or a suitable emulsification device such as ball mills, attriters, sand grinders and the like, and a coating solution is prepared by adding a binder and various additive materials depending on the objective.

A target thermosensitive recording medium can be prepared by applying the coating solution described above on a support material such as paper, recycled paper, synthetic paper, film, plastic film, plastic foam film, non-woven cloth and the like. In addition, a composite sheet combining these support materials may also be used as the support material.

An undercoating layer comprising a polymeric substance containing a pigment and the like may be installed under the thermosensitive recording layer for the purpose of enhancing the color developing sensitivity in the thermosensitive recording medium of the present invention. In addition, a back coating layer may be installed on the support medium surface opposite the surface on which is applied a thermosensitive recording layer to correct the curl. In addition, an intermediate layer may be installed between a thermosensitive recording layer and a protective layer.

In order to coat each layer, any conventional application technique such as blade coating, air knife coating, curtain coating, gravure coating, roller coater coating, and the like can be used. As a coating method to coat protective layers that contain acrylic resin of the present invention, preferred are blade coating, roller coater coating and gravure coating, which are contact type application methods, and blade coating is especially preferred.

Blade coating method is an application technique to form a coating surface on a support by spreading coating solution on a support and then applying a blade on the support at a specific angle under a load to scrape excessive coating solution. Blade coating method is characterized in that (i) a high share is applied to a coating solution, (ii) a coated surface is highly smooth, and (iii) a coated surface tends to have defects such as streaks (non-coated part with long stick shape remains on a surface) or scratches (non-coated part with short scratches remains on a surface) caused by aggregates of solid particles contained in a coating solution.

Roller coater coating method is an application technique to form a coating surface on a support by transferring a coating solution dispersed on an applicator roll to a support. Roller coater coating method is characterized in that (i) a high share is applied to a coating solution, (ii) a coated surface is like a surface made by a contour coating, (iii) both sides can be applied once by configuring rolls appropriately, and (iv) a coated surface tends to be disturbed, that is, a coating pattern tends to be disturbed.

Gravure coating method is an application technique to form a coating surface on a support by transferring a coating solution in recesses on an applicator roll to a support, wherein the applicator roll has recesses on the surface graved to form an etching pattern. Gravure coating method is, similarly to a roller coater coating method, characterized in that (i) a high share is applied to a coating solution, (ii) a coated surface is less disturbed than roller coater coating method, and (iii) both sides can be applied once by configuring rolls appropriately.

Air knife coating method is an application technique to form a coating surface on a support by spreading coating solution on a support and then blowing air on the support to scrape excessive coating solution. As compared with blade coating method, air knife coating method is characterized in that (i) a share applied to a coating solution is lower, (ii) a coating solution with low viscosity can be applied, (iii) a coated surface has less coating defects, and (iv) a coated surface tends to be disturbed, that is, a surface tends to have a blow pattern, due to air blow.

Curtain coating method is an application technique to form a coating surface on a support by forming a free falling curtain of coating solution through a slit and then passing a moving support through the curtain. Curtain coating method is characterized in that (i) the share applied to a coating solution is extremely lower than that of blade coating method and air knife coating method, since this method lacks a process of scraping coating solution. The curtain coating method is also characterized in that (ii) contour coating is possible, and (iii) a coated surface tends to have defects such as bubble defects caused by bubbles contained in the coating solution (non-coated part with oval shape remains on a surface) or disturbed surface caused the air contained in the coating solution when the free falling curtain contacts with the moving substrate.

The reason why blade coating, roller coater coating and gravure coating are preferred as a coating method for a protective layer is that solvent resistance and plasticizer resistance improves because the protective layer becomes dense due to the high share of the coating solution. The blade coating is more preferred because the share of the coating solution is higher and the protective layer becomes denser.

The coating amount of the protective layer is ordinarily in the range of from 1 $g/m^2$ to 5 $g/m^2$.

Furthermore, various technologies known in the thermosensitive recording medium field may be used as needed, for example, a flattening treatment such as super calendaring and the like can be conducted after coating individual coating layers.

EXAMPLES

The following examples will illustrate the present invention, but these are not intended to restrict the present invention. In the following description, the terms parts and % indicate parts by weight and wt. %, respectively. Diameter of pigments was measured by taking a photograph of the pigment, measuring each length in X, Y and Z axes, choosing the longest and the second longest, averaging these for an averaged diameter for one particle, and averaging the averaged diameters for 100 pigment particles. The aspect ratio of pigments was obtained by measuring diameter and thickness for 100 powder particles, and calculating the averaged ratio of diameter/thickness of these.

Example 1

The mixture of the following formulation was blended and dispersed to prepare an undercoating layer coating solution.

Undercoating Layer Coating Solution

| | |
|---|---|
| Calcined kaolin (Engelhard Co., Ansilex 90) | 100 parts |
| Styrene-butadiene copolymer latex (solid content: 48%) | 40 parts |
| 10% Aqueous solution of completely saponified polyvinyl alcohol (Kuraray Co., Ltd. PVA117, degree of polymerization about 1,700, degree of saponification 98-99 mole %, sodium acetate content less than 1%) | 30 parts |
| Water | 160 parts |

This undercoating layer coating solution was applied on a support material (paper with 47 g/m$^2$ of basic weight) and was dried to prepare an undercoated paper with a coating amount of 10.0 g/m$^2$. The coating was conducted by using a blade coater (manufactured by Voith IHI Paper Technology Co., Ltd.) with a coating speed of 500 m/min (blade coating method).

Then a color development agent dispersion (solution A), a dye dispersion (solution B) and a sensitizer dispersion (solution C) with the following formulation were separately wet ground using sand grinders until the average particle size was about 0.5 μm.

Solution A (Color Development Agent Dispersion)

| | |
|---|---|
| 4-Hydroxy-4'-isopropoxy diphenyl sulfone | 6.0 parts |
| 10% Aqueous solution of polyvinyl alcohol | 18.8 parts |
| Water | 11.2 parts |

Solution B (Dye Dispersion)

| | |
|---|---|
| 3-Dibutylamino-6-methyl-7-anilinofluorane (Yamamoto Chemicals Inc. ODB-2) | 3.0 parts |
| 10% Aqueous solution of polyvinyl alcohol | 6.9 parts |
| Water | 3.9 parts |

Solution C (Sensitizer Dispersion)

| | |
|---|---|
| Di-benzyl Oxalate | 6.0 parts |
| 10% Aqueous solution of polyvinyl alcohol | 18.8 parts |
| Water | 11.2 parts |

Next the dispersions were blended in the proportion described below to prepare a coating solution for a thermosensitive recording layer.

Thermosensitive Color Developing Layer Coating Solution

| | |
|---|---|
| Solution A (color development agent dispersion) | 36.0 parts |
| Solution B (dye dispersion) | 13.8 parts |
| Solution C (sensitizer dispersion) | 36.0 parts |
| 10% Aqueous solution of completely saponified polyvinyl alcohol (Kuraray Co., Ltd. PVA117) | 25.0 parts |

This thermosensitive color developing layer coating solution was applied on the undercoated paper obtained above with a coating amount of 6.0 g/m$^2$ and was dried to prepare an thermosensitive color developing paper. The coating was conducted by using a curtain coater (manufactured by Voith IHI Paper Technology Co.,Ltd.) with a coating speed of 500 m/min (curtain coating method).

Then a protective layer coating solution was prepared next by mixing the following ingredients in the proportion described below.

Protective Layer Coating Solution

| | |
|---|---|
| Acrylic resin (Mitsui Chemicals, Inc., non-core-shall type acrylic resin XNP4, solid content 18%, Tg 55 degree C.) | 30.0 parts |
| Zinc stearate (Chukyo Yushi Co., Ltd.: HydrinZ-7-30, solid content 30%) | 2.0 parts |

Next, this protective layer coating solution was applied on the thermosensitive color developing paper with a coating amount of 3.0 g/m$^2$ and dried. The coating was conducted by using the curtain coating method described above. Then the sheet was super calendared to a degree of smoothness of 1,000 to 2,000 seconds to yield a thermosensitive recording medium.

Example 2

A thermosensitive recording medium was prepared in the same manner described in Example 1 with the exception of adding 10 parts of 10% aqueous solution of completely saponified polyvinyl alcohol (Kuraray Co., Ltd. PVA117) to the protective layer coating solution.

Example 3

A thermosensitive recording medium was prepared in the same manner described in Example 1 with the exception of adding 9.0 parts of 50% kaolin dispersion (IMERYS Co., Contour1500, aspect ratio: 60, average diameter: 2.5 μm) to the protective layer coating solution.

Example 4

A thermosensitive recording medium was prepared in the same manner described in Example 3 with the exception of changing the kaolin in the protective layer coating solution to another kaolin (IMERYS Co., Astra-Plate, aspect ratio: 34, average diameter: 2.0 μm).

Example 5

A thermosensitive recording medium was prepared in the same manner described in Example 3 with the exception of changing the kaolin in the protective layer coating solution to aluminum hydroxide (Martinsberg: Martifin, aspect ratio: 5, average diameter: 3.5 μm).

Example 6

A thermosensitive recording medium was prepared in the same manner described in Example 1 with the exception of changing di-benzyl oxalate, the sensitizer dispersion, in the solution C to diphenyl sulfone, adding 10 parts of 10% aqueous solution of completely saponified polyvinyl alcohol (Kuraray Co., Ltd. PVA117) to the protective layer coating solution, and applying the protective layer coating solution with the blade coating method described above.

Example 7

A thermosensitive recording medium was prepared in the same manner described in Example 6 with the exception of changing the acrylic resin in the protective layer coating solution to a core-shell type acrylic resin (Mitsui Chemicals, Inc., Barrierstar B1000, Tg 94 degrees C.).

Example 8

A thermosensitive recording medium was prepared in the same manner described in Example 6 with the exception of adding 10 parts of 5% aqueous solution of methyl cellulose (Shin-Etsu Chemical Co., Ltd., Metolose SM15) to the protective layer coating solution.

Example 9

A thermosensitive recording medium was prepared in the same manner described in Example 6 with the exception of changing the completely saponified polyvinyl alcohol in the protective layer coating solution to a starch (Oji Cornstarch Co. Ltd, Ohji Ace B).

Example 10

A thermosensitive recording medium was prepared in the same manner described in Example 8 with the exception of changing the amount of the 10% aqueous solution of completely saponified polyvinyl alcohol in the thermosensitive color developing layer coating solution to 10 parts, adding 15 parts of 10% Carboxyl modified polyvinyl alcohol (Kuraray Co., Ltd.: KL118), and adding 3 parts of Polyamide epichlorohydrin (Seiko PMC: WS4020, 25%).

Example 11

A thermosensitive recording medium was prepared in the same manner described in Example 10 with the exception of adding 9.0 parts of 50% kaolin dispersion (IMERYS Co., Contour1500, aspect ratio: 60, average diameter: 2.5 μm) to the protective layer coating solution.

Example 12

A thermosensitive recording medium was prepared in the same manner described in Example 11 with the exception of changing the kaolin in the protective layer coating solution to another kaolin (IMERYS Co., Astra-Plate, aspect ratio: 34, average diameter: 2.0 μm).

Example 13

A thermosensitive recording medium was prepared in the same manner described in Example 11 with the exception of changing the kaolin in the protective layer coating solution to aluminum hydroxide (Martinsberg: Martifin, aspect ratio: 5, average diameter: 3.5 μm).

Comparative Example 1

A thermosensitive recording medium was prepared in the same manner described in Example 3 with the exception of changing the acrylic resin in the protective layer coating solution to a completely saponified polyvinyl alcohol (Kuraray Co., Ltd., PVA117) and adding 5.0 parts of 40% Glyoxal solution.

Comparative Example 2

A thermosensitive recording medium was prepared in the same manner described in Example 3 with the exception of changing the acrylic resin in the protective layer coating solution to a non-core-shell type acrylic resin (Mitsui Chemicals, Inc., XNP3, Tg 45 degrees C.).

Comparative Example 3

A thermosensitive recording medium was prepared in the same manner described in Example 3 with the exception of changing the acrylic resin in the protective layer coating solution to a core-shell type acrylic resin (Nippon Paint Co., Ltd., N-538, Tg 100 degrees C.).

Comparative Example 4

A thermosensitive recording medium was prepared in the same manner described in Example 6 with the exception of changing the acrylic resin in the protective layer coating solution to a completely saponified polyvinyl alcohol (Kuraray Co., Ltd., PVA117) and adding 5.0 parts of 40% Glyoxal solution.

Comparative Example 5

A thermosensitive recording medium was prepared in the same manner described in Example 6 with the exception of changing the acrylic resin in the protective layer coating solution to a non-core-shell type acrylic resin (Mitsui Chemicals, Inc., XNP3, Tg 45 degrees C.).

Comparative Example 6

A thermosensitive recording medium was prepared in the same manner described in Example 6 with the exception of changing the acrylic resin in the protective layer coating solution to a core-shell type acrylic resin (Nippon Paint Co., Ltd., N-538, Tg 100 degrees C.).

The thermosensitive recording media obtained in the manners described above were evaluated as follows.

<Recording Sensitivity>

The prepared thermosensitive recording medium were recorded by using a printing tester for thermosensitive recording paper (Okura Engineering Co. LTD., TH-PMD equipped with a thermal head by Kyocera Corporation.) at recording energy of 0.41 mJ/dot and recording speed of 50 or 100 mm/sec. The density of the recorded image was measured by using Macbeth Densitometer (RD-914, with Amber filter).

<Water Resistance>

10 μl of tap water was dropped on a coated surface of the recorded thermosensitive recording medium after the recording sensitivity evaluation above. Then the thermosensitive recording medium sample was folded so that the recording layer is inside. The folded thermosensitive recording medium sample was left standing for 24 hours at 40 degrees C. 90% RH under added load of 10 g/cm$^2$.

Good: No blocking and no peeling of the recording layer

Fair: Slight blocking

Poor: Blocking is observed, and some part of recording layer was peeled and reading of recorded part is difficult.

<Water Immersion Resistance>

The recorded thermosensitive recording medium obtained after the recording sensitivity test (50 mm/sec.) was immersed in a tap water for 24 hours and then the surface of the thermosensitive recording medium was rubbed with fingers. The surface was evaluated by the following criteria:

Good: No flaking of the coated layer and printed letters are readable.

Fair: Slight flaking of the coated layer but printed letters are readable.

Poor: Flaking of the coated layer and printed letters are not readable.

<Sticking Resistance>

Sticking resistance test was conducted under the condition that the thermosensitive recording medium was printed by a printing tester (Okura Engineering Co. LTD., TH-PMD) at recording energy of 0.41 mJ/dot and recording speed of 50 mm/sec at −10 degrees C. Sticking resistance was evaluated by the following criteria:

Good: No unprinted area in recorded part and almost no noise

Fair: Some unprinted areas in recorded part and almost no noise

Poor: A lot of unprinted areas in recorded part and high noise

"Unprinted area" and "noise" are caused because the outermost layer of the medium sticks to the head of the printing tester.

<Scratching Resistance>

The coated surface of the medium was scratched by a steel wool under a load of 1000 g/cm$^2$. Scratch resistance was evaluated by the following criteria:

Good: Almost no color development

Fair: Slight color development

Poor: Deep color development

<Plasticizer Resistance>

A paper tube was wrapped once with polyvinyl chloride wrap (Mitsui Toatsu Chemical: High Wrap KMA) and the recorded thermosensitive recording medium obtained after the recording sensitivity test (50 mm/sec.) was applied on the wrapped paper tube. Furthermore, the tube was wrapped 3 times with polyvinyl chloride wrap and was left standing for 24 hours at 23° C. The Macbeth density of the recorded section was measured.

<Solvent Resistance>

The recorded thermosensitive recording medium obtained after the recording sensitivity test (50 mm/sec.) was coated with ethyl acetate (99.5%) by using a cotton swab and was left standing for 24 hours. The Macbeth density of the recorded section was measured.

<Image Quality>

The prepared thermosensitive recording medium was recorded solidly by a printing tester for thermosensitive recording paper (Okura Engineering Co. LTD., TH-PMD equipped with a thermal head by Kyocera Corporation.) at recording energy of 0.27 mJ/dot. The image quality of the recorded image was evaluated by the following criteria by a visual inspection:

Excellent: Almost no uneven color development with evenly solid color

Good: Slight uneven color development with almost evenly solid color

Fair: Partially uneven color development with solid color

Poor : No solid color developed

<Coating Defects>

The prepared thermosensitive recording medium was visually inspected to evaluate if there are coating defects on the surface. Coating defects are, for example, streaks, which are a shape of narrow stick, and bubbles, which are a narrow oval shape, remained on the coated surface. The coating defect was evaluated by the following criteria:

Excellent: Less than 2 defects per 10 m$^2$ of the medium

Good: Less than 4 and more than or equal to 2 defects per 10 m$^2$ of the medium Fair: Less than 8 and more than or equal to 4 defects per 10 m$^2$ of the medium Poor: More than or equal to 8 defects per 10 m$^2$ of the medium The evaluation results are shown in Table 1. In the table, PVA, CPVA, PAE, MC, CSAC and NCSAR stand for polyvinyl alcohol, completely saponified polyvinyl alcohol, carboxyl modified polyvinyl alcohol, polyamide epichlorohydrin, methyl cellulose, core-shell type acrylic resin and non-core-shell type acrylic resin, respectively.

TABLE 1

| | | thermosensitive recording layer | protective layer: resin | protective layer: water soluble polymer | protective layer: pigment | protective layer: coating method | recording sensitivity: 50 mm/sec | recording sensitivity: 100 mm/sec | water resistance |
|---|---|---|---|---|---|---|---|---|---|
| Examples | 1 | PVA | NCSAR | NA | NA | curtain | 1.43 | 1.41 | Good |
| | 2 | ↑ | ↑ | PVA | ↑ | ↑ | 1.45 | 1.44 | Good |
| | 3 | ↑ | ↑ | NA | Kaoline | ↑ | 1.53 | 1.50 | Good |
| | 4 | ↑ | ↑ | ↑ | ↑ | ↑ | 1.49 | 1.47 | Good |
| | 5 | ↑ | ↑ | ↑ | aluminium hydroxide | ↑ | 1.48 | 1.46 | Good |
| | 6 | ↑ | ↑ | PVA | NA | blade | 1.47 | 1.44 | Good |
| | 7 | ↑ | CSAR | ↑ | ↑ | ↑ | 1.36 | 1.16 | Fair |
| | 8 | ↑ | NCSAR | PVA + MC | ↑ | ↑ | 1.46 | 1.43 | Good |
| | 9 | ↑ | ↑ | starch | ↑ | ↑ | 1.44 | 1.40 | Good |
| | 10 | PVA + CPVA + PAE | ↑ | PVA + MC | ↑ | ↑ | 1.45 | 1.43 | Good |
| | 11 | ↑ | ↑ | ↑ | Kaoline | ↑ | 1.57 | 1.56 | Good |
| | 12 | ↑ | ↑ | ↑ | ↑ | ↑ | 1.54 | 1.51 | Good |
| | 13 | ↑ | ↑ | ↑ | aluminium hydroxide | ↑ | 1.53 | 1.52 | Good |
| Comparative Example | 1 | PVA | PVA + glyoxal | NA | Kaoline | curtain | 1.35 | 1.16 | Poor |
| | 2 | ↑ | NCSAR | ↑ | ↑ | ↑ | 1.44 | 1.42 | Good |
| | 3 | ↑ | CSAR | ↑ | ↑ | ↑ | 1.36 | 1.30 | Fair |
| | 4 | ↑ | PVA + glyoxal | PVA | NA | blade | 1.34 | 1.17 | Poor |
| | 5 | ↑ | NCSAR | ↑ | ↑ | ↑ | 1.43 | 1.41 | Good |
| | 6 | ↑ | CSAR | ↑ | ↑ | ↑ | 1.37 | 1.25 | Fair |

TABLE 1-continued

| | | water immersion resistance | sticking resistance | scratching resistance | plasticizer resistance | solvent resistance | image quality | coating defects |
|---|---|---|---|---|---|---|---|---|
| Examples | 1 | Fair | Fair | Good | 1.20 | 1.20 | Good | Fair |
| | 2 | Fair | Fair | Good | 1.23 | 1.20 | Good | Good |
| | 3 | Fair | Good | Good | 1.51 | 1.52 | Good | Good |
| | 4 | Fair | Good | Good | 1.49 | 1.48 | Good | Good |
| | 5 | Fair | Good | Good | 1.44 | 1.40 | Good | Good |
| | 6 | Fair | Fair | Good | 1.34 | 1.32 | Good | Good |
| | 7 | Fair | Good | Fair | 1.03 | 1.02 | Good | Good |
| | 8 | Fair | Fair | Good | 1.34 | 1.35 | Excellent | Excellent |
| | 9 | Fair | Fair | Good | 1.27 | 1.26 | Good | Fair |
| | 10 | Good | Fair | Good | 1.30 | 1.29 | Excellent | Excellent |
| | 11 | Good | Good | Good | 1.56 | 1.55 | Excellent | Excellent |
| | 12 | Good | Good | Good | 1.54 | 1.53 | Excellent | Excellent |
| | 13 | Good | Good | Good | 1.50 | 1.47 | Excellent | Excellent |
| Comparative Example | 1 | Poor | Good | Poor | 1.30 | 1.30 | Fair | Good |
| | 2 | Fair | Poor | Fair | 1.39 | 1.39 | Fair | Fair |
| | 3 | Poor | Fair | Fair | 1.05 | 1.02 | Fair | Fair |
| | 4 | Poor | Good | Poor | 1.32 | 1.32 | Fair | Fair |
| | 5 | Fair | Poor | Fair | 1.41 | 1.42 | Good | Fair |
| | 6 | Poor | Fair | Fair | 1.08 | 1.06 | Good | Fair |

What is claimed is:

1. A thermosensitive recording medium having a thermosensitive recording layer on a support and a protective layer on the thermosensitive recording layer, wherein the protective layer comprises an acrylic resin with a glass transition temperature of higher than 50 degrees C. and lower than or equal to 95 degrees C. and the protective layer further contains a cellulose ether, wherein the amount of the cellulose ether is, in terms of solid content, from 5 to 70 parts by weight per 100 parts by weight of the solid content of the acrylic resin.

2. The thermosensitive recording medium of claim 1, wherein the acrylic resin is a non-core-shell type acrylic resin.

3. The thermosensitive recording medium of claim 2, wherein the protective layer was coated with a blade coating method.

4. The thermosensitive recording medium of claim 3, wherein the protective layer further contains a pigment.

5. The thermosensitive recording medium of claim 2, wherein the protective layer further contains a pigment.

6. The thermosensitive recording medium of claim 1, wherein the protective layer was coated with a blade coating method.

7. The thermosensitive recording medium of claim 6, wherein the protective layer further contains a pigment.

8. The thermosensitive recording medium of claim 1, wherein the cellulose ether is hydroxyethyl cellulose, methyl cellulose, ethyl cellulose, carboxymethyl cellulose, acetyl cellulose or a derivative thereof.

9. The thermosensitive recording medium of claim 8, wherein the protective layer further contains a pigment.

10. The thermosensitive recording medium of claim 1, wherein the protective layer further contains polyvinyl alcohols.

11. The thermosensitive recording medium of any one of claim 1 to 10 or 3, wherein the thermosensitive recording layer contains at least one of a carboxyl modified polyvinyl alcohol and an epichlorohydrin type resin.

12. The thermosensitive recording medium of claim 11, wherein the protective layer further contains a pigment.

13. The thermosensitive recording medium of claim 10, wherein the protective layer further contains a pigment.

14. The thermosensitive recording medium of claim 1, wherein the protective layer further contains a pigment.

15. The thermosensitive recording medium of claim 14, wherein the aspect ratio of the pigment is more than or equal to 30.

16. The thermosensitive recording medium of claim 15, wherein the pigment is kaolin.

17. The thermosensitive recording medium of claim 14, wherein the pigment is kaolin.

* * * * *

UNITED STATES PATENT AND TRADEMARK OFFICE

CERTIFICATE OF CORRECTION

PATENT NO. : 8,609,582 B2
APPLICATION NO. : 13/254381
DATED : December 17, 2013
INVENTOR(S) : Hirai It is certified that error appears in the above-identified patent and that said Letters Patent is hereby corrected as shown below:

In the Specification

On column 8, line 54
replace "meq/g[redacted]solid"
with --meq/g•solid--.

Signed and Sealed this
Fourth Day of March, 2014

Michelle K. Lee

Michelle K. Lee
*Deputy Director of the United States Patent and Trademark Office*